US010016061B2

(12) United States Patent
Brueske

(10) Patent No.: US 10,016,061 B2
(45) Date of Patent: Jul. 10, 2018

(54) BACKREST FOR AN OFFICE CHAIR

(71) Applicant: INTERSTUHL BUEROMOEBEL GMBH & CO. KG, Messstetten (DE)

(72) Inventor: Joachim Brueske, Berlin (DE)

(73) Assignee: Interstuhl Bueromoebel GmbH & Co. KG, Messstetten (DE)

( * ) Notice: Subject to any disclaimer, the term of this patent is extended or adjusted under 35 U.S.C. 154(b) by 0 days.

(21) Appl. No.: 15/431,876

(22) Filed: Feb. 14, 2017

(65) Prior Publication Data

US 2017/0231395 A1 Aug. 17, 2017

(30) Foreign Application Priority Data

Feb. 15, 2016 (DE) ..... 10 2016 102 556

(51) Int. Cl.

| | |
|---|---|
| ***A47C 3/025*** | (2006.01) |
| ***A47C 3/026*** | (2006.01) |
| ***A47C 3/12*** | (2006.01) |
| ***A47C 7/44*** | (2006.01) |
| ***A47C 7/00*** | (2006.01) |
| ***A47C 7/46*** | (2006.01) |

(52) U.S. Cl.

CPC ..... *A47C 7/445* (2013.01); *A47C 7/004* (2013.01); *A47C 7/006* (2013.01); *A47C 7/44* (2013.01); *A47C 7/462* (2013.01)

(58) Field of Classification Search

CPC ..... A47C 7/004; A47C 7/006; A47C 7/44; A47C 7/445; A47C 7/462

USPC ..... 297/296, 297, 298, 452.13, 452.14, 297/452.15, 285

See application file for complete search history.

(56) References Cited

U.S. PATENT DOCUMENTS

| | | | | |
|---|---|---|---|---|
| 2,530,924 | A * | 11/1950 | Turner | A47C 1/033 297/452.15 X |
| 3,185,430 | A | 5/1965 | Bernard | |
| 3,455,601 | A | 7/1969 | Lie | |
| 3,583,759 | A * | 6/1971 | Kramer | A47C 3/12 297/452.14 X |
| 3,669,499 | A * | 6/1972 | Semplonius | A47C 3/12 297/452.14 |
| 4,123,105 | A * | 10/1978 | Frey | A47C 5/12 297/452.14 X |
| 4,889,385 | A * | 12/1989 | Chadwick | A47C 3/026 297/285 |
| 4,911,501 | A * | 3/1990 | Decker | A47C 1/03255 297/285 |
| 5,015,038 | A * | 5/1991 | Mrotz, III | A47C 3/12 297/452.15 |

(Continued)

FOREIGN PATENT DOCUMENTS

| | | |
|---|---|---|
| DE | 1938204 | 5/1966 |
| DE | 2319846 | 10/1974 |

(Continued)

*Primary Examiner* — Rodney B White

(74) *Attorney, Agent, or Firm* — Collard & Roe, P.C.

(57) ABSTRACT

A backrest for an office chair. The backrest has a support structure on which a backrest shell element can be fastened. The support structure is formed with two braces that which are interconnected at upper and lower end regions and that are spaced from each other between the upper and lower end regions. At least sections of the braces are movable relative to one another.

13 Claims, 2 Drawing Sheets

(56) References Cited

U.S. PATENT DOCUMENTS 5,039,164 A * 8/1991 Gibbs ..... A47C 3/0252 297/285 X
5,102,196 A * 4/1992 Kaneda ..... A47C 7/405 297/285
5,314,240 A * 5/1994 Ishi ..... A47C 1/03255 297/452.15
5,318,346 A * 6/1994 Roossien ..... A47C 3/12 297/452.15 X
5,487,591 A * 1/1996 Knoblock ..... A47C 1/03255 297/452.14 X
5,664,835 A * 9/1997 Desanta ..... A47C 3/021 297/452.15 X
5,704,688 A * 1/1998 Schrewe ..... A47C 7/46 297/285
5,909,923 A * 6/1999 DeKraker ..... A47C 1/023 297/285
5,957,534 A * 9/1999 Wilkerson ..... A47C 1/03255 297/452.14 X
RE36,335 E 10/1999 Perry
6,257,665 B1 * 7/2001 Nagamitsu ..... A47C 7/405 297/285
6,565,153 B2 * 5/2003 Hensel ..... A47C 7/38 297/285
6,729,691 B2 * 5/2004 Koepke ..... A47C 1/03255 297/452.13
6,896,328 B2 * 5/2005 Goodworth ..... A47C 3/026 297/297
7,226,127 B1 * 6/2007 Yevko ..... A47C 7/44 297/296 X
7,568,765 B2 * 8/2009 Brauning ..... A47C 7/38 297/452.13 X
7,712,833 B2 * 5/2010 Ueda ..... A47C 1/03255 297/296
7,770,973 B2 * 8/2010 Gehner ..... A47C 1/023 297/298 X
7,862,120 B2 * 1/2011 Ueda ..... A47C 1/03255 297/285
7,891,740 B2 * 2/2011 Boes ..... B60N 2/686 297/452.14
8,251,454 B2 * 8/2012 Tsukiji ..... A47C 7/282 297/452.13 X
8,282,172 B2 * 10/2012 Schmitz ..... A47C 1/03255 297/452.14 X
8,297,708 B2 * 10/2012 Mizobata ..... B60N 2/7011 297/452.13 X
8,567,864 B2 * 10/2013 Deisig ..... A47C 3/045 297/285
8,602,501 B2 * 12/2013 Walker ..... A47C 7/42 297/452.14
8,820,835 B2 * 9/2014 Minino ..... A47C 7/44 297/285
8,973,990 B2 * 3/2015 Krupiczewicz ..... A47C 31/02 297/452.14 X
8,998,338 B2 * 4/2015 Vander Veen ..... A47C 1/032 297/452.14
8,998,339 B2 * 4/2015 Peterson ..... A47C 1/024 297/285
9,027,997 B2 * 5/2015 Battey ..... A47C 1/032 297/296 X
9,332,851 B2 5/2016 Machael et al.
9,504,325 B2 11/2016 Sander et al.
2004/0080197 A1 4/2004 Kopetzky
2006/0097558 A1 5/2006 Aubert
2006/0138829 A1 6/2006 Kopetzky
2007/0108819 A1 5/2007 Ueda
2010/0244521 A1 * 9/2010 Ueda ..... A47C 1/03255 297/298
2011/0278889 A1 * 11/2011 Sienkowski ..... A47C 3/00 297/297 X
2015/0296989 A1 * 10/2015 Machael ..... A47C 7/44 297/284.7
2016/0135603 A1 * 5/2016 Chan ..... A47C 7/36 297/284.7

FOREIGN PATENT DOCUMENTS

DE 7631908 4/1978
DE 3724605 2/1989
DE 69129628 10/1998
DE 20316384 3/2004
DE 102004053965 5/2006
DE 60313010 12/2007
DE 102011104972 12/2012
WO WO 2013083562 6/2013

* cited by examiner

BACKREST FOR AN OFFICE CHAIR

CROSS-REFERENCE TO A RELATED APPLICATION

The invention described and claimed hereinbelow also is described in German Patent Application 10 2016 102 556.9, filed on Feb. 15, 2016. The subject matter of the German Patent Application is incorporated herein by reference and, provides the basis for a claim of priority of invention under 35 U.S.C. 119(a)-(d).

BACKGROUND OF THE INVENTION

The present invention relates to a backrest for an office chair having a support structure, on which a backrest shell element can be fastened.

WO2013/083562 A1 describes an office chair comprising a backrest and a seat surface. The seat surface is operatively connected to the backrest. The office chair comprises a connection element. The connection element is connected to the backrest and the seat surface and is designed to counteract a pivoting movement of the backrest in a resilient manner. The connection element is designed to pivot along with the seat surface in a predetermined manner in relation to the pivoting movement of the backrest, and therefore the backrest and the seat surface, during the pivoting of the backrest, open one another at an opening angle.

Such an office chair is particularly well suited for assisting a user to occasionally change his seated position, to avoid back discomfort to the greatest extent possible.

SUMMARY OF THE INVENTION

The present invention overcomes shortcomings of known arts, such as those mentioned above.

The present invention refines the office chair in such a way that interplay between the seat surface and the backrest prompts a user to "move while sitting," and so that even further flexibility exists with respect to assuming, different seated positions.

In an embodiment, the invention provides a backrest for an office chair having a support structure, on which a backrest shell element is fastened. The support structure comprises two braces that are interconnected at respective upper and lower end regions and that are spaced from each other between the end regions. The at least sections of the braces are movable relative to one another. This design of the support structure of the backrest results in a flexibility of the backrest, and therefore the backrest adapts to movements and changes in sitting positions by a user. The back of a user is nevertheless optimally supported.

Preferably, the support structure is made from plastic. A certain flexibility and elasticity therefore results due solely to the material property.

In an embodiment, the support structure has connection points for the point connection to the backrest shell element. The support structure can have openings, into which connection elements of the backrest shell element can be inserted. The connection points are designed in such a way that an insertion connection is possible. If the backrest shell element is connected to the support structure only at points, even slight relative movements between the backrest shell element and the support structure are permitted, which results in greater flexibility of the backrest overall.

In an embodiment, each of the braces has a backrest leg which is elastic at least in some areas. The braces are connected to a base support by way of the backrest legs. A further elasticity of the backrest is effectuated by way of the backrest legs.

According to a refinement, the backrest leg is c-shaped. This results in a resilient design of the backrest leg.

The braces preferably are connected to a base support that is attachable to or connected to a pedestal. The base support can be one of the connections in an end region of the braces. In addition, a seat brace is situated on the base support or connected or connectable thereto.

The braces are oriented in parallel to one another in a first section, for example, in an area of the upper back. A panel, preferably made of elastic plastic, is provided between the braces.

The distance between the braces can increase in a second section, for example, toward a base support. The distance can continuously increase in this case. Alternatively, the distance can be increased in a stepped manner. In a refinement, the braces are designed to be more stable in this area, to prevent the backrest from buckling in the area of the braces.

The backrest comprises a backrest shell element connected to the support structure. The backrest shell element is designed, in this case, in such a way that it offers further flexibility and adapts to movements by a user. The backrest shell element is inserted or insertable onto the support structure.

In an embodiment, the backrest shell element has a plurality of through-holes having webs situated therebetween. The number of through-holes of the plurality of through-holes is large. This ensures that the backrest shell element is not rigid, but rather has a certain flexibility and elasticity. In addition, material and weight can be saved in this manner.

According to one refinement, through-holes, which alternate in the vertical direction, are situated at a first height and at a second, greater height. Therefore, through-holes alternate at different heights. The flexibility and elasticity of the backrest shell element can be adjusted by way of the selection of the height of the through-holes.

The backrest shell element can have one central vertical row of through-holes, wherein assigned to each through-hole of the central vertical row of through-holes is a narrower through-hole on the right and the left. Therefore, as viewed in the horizontal direction, first a narrow through-hole is provided, then a wider, central through-hole, and finally another narrower through-hole. In this way, a greater flexibility is achieved in a central area than in an area situated next to the central area.

In addition, the through-holes of the central row of through-holes become wider from the top to the bottom. Thus, the backrest shell element has a greater flexibility in a lower area, in particular in the area of a lumbar spine of a user, than in an area situated thereabove.

Further advantages result when slot-like openings are provided. Slot-like openings can extend, in this case, approximately across the entire width of the backrest shell element. Also, multiple slot-like openings are provided in the horizontal direction. A further adjustment of the properties of the backrest shell element can take place by way of the arrangement and length of the slot-like openings.

Consequently, the backrest shell element can have a skeleton-like design, for example, comprising multiple webs that are spaced from each other by openings.

Elastic fastening tabs for the detachable fastening on the support structure are preferably provided on the backrest shell element. The point connection of the backrest shell element to the support structure can take place by way of the fastening tabs. Given that the fastening tabs are preferably elastic, the backrest shell element is movable to a limited extent relative to the support structure.

An office chair comprising the inventive backrest also falls within the scope of the invention.

It is understood that the features mentioned above and which are described in the following may be used not only in the combination described, but also in other combinations or alone, without departing from the scope of the present disclosure.

DETAILED DESCRIPTION OF THE INVENTION

The following is a detailed description of example embodiments of the invention depicted in the accompanying drawings. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

Figure 1:
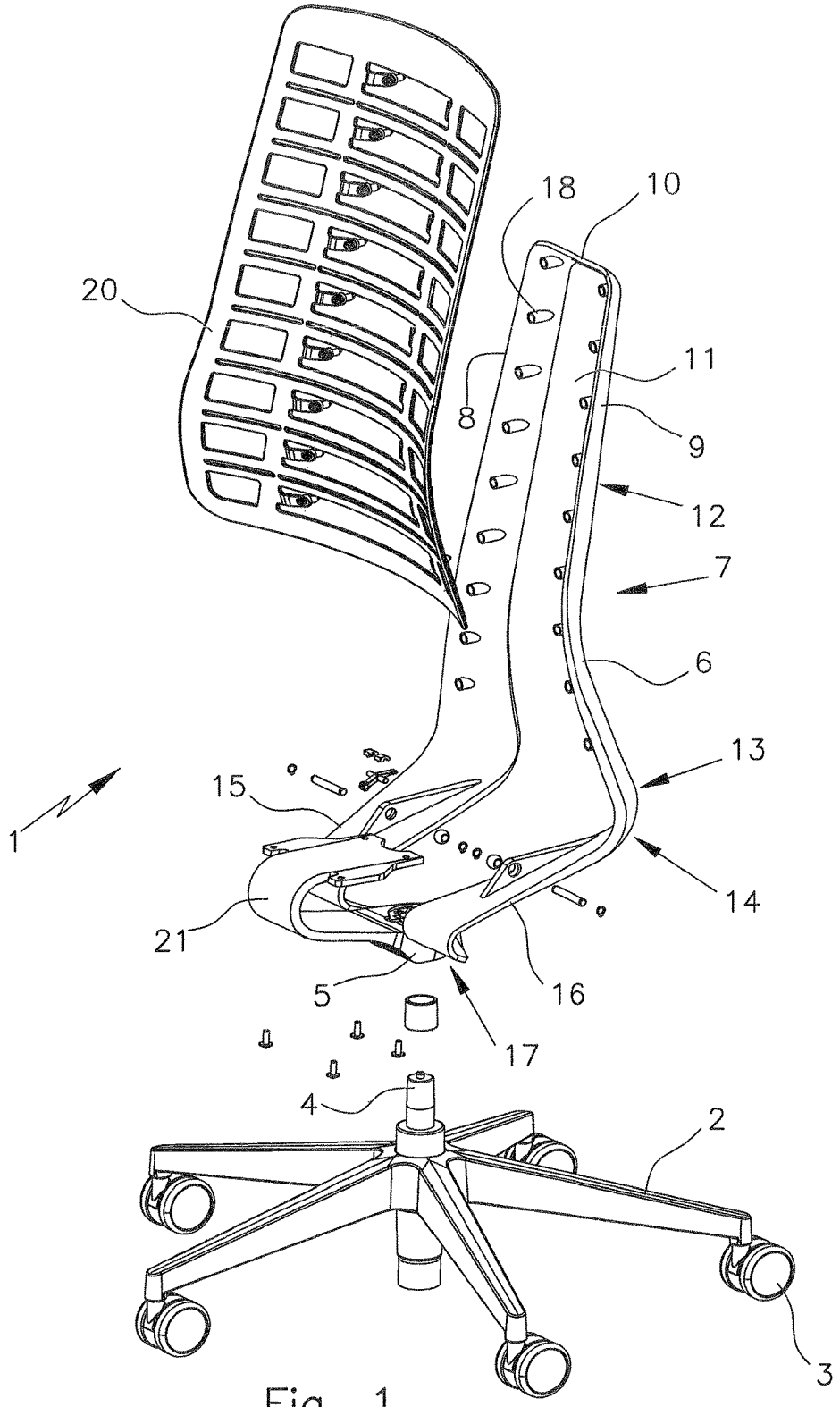
FIG. 1 shows a partial exploded illustration of an office chair.

FIG. 1 presents an exploded illustration of an office chair 1. The office chair 1 comprises a five-arm pedestal 2 having rollers 3. A base support 5 can be fastened on a central column 4 of the pedestal 2. A support structure 6 of a backrest 7 extends upward from the base support 5. The support structure 6 includes, in this case, two braces 8, 9 which are interconnected by way of the connection web 10 at an upper end of the support structure 6 and by way of the base support 5 at a lower end of the support structure 6. Located between the braces 8, 9 is an intermediate space 11 that can be open, or that can be hidden by a plastic plate. In a first section 12, the braces 8, 9 extend at least partially in parallel. In a second section 13, the distance between the braces 8, 9 increases. The support structure 6 widens toward the base support 5. The braces 8, 9 also become wider toward a bend area 14. In a lower area, the support structure 6 comprises backrest legs 15, 16, which are elastic at least in some areas and are c-shaped, as viewed in cross section, at least in one area 17.

The support structure 6 has receptacles 18 along the braces 8, 9 for accommodating fastening tabs of a backrest shell element 20. The backrest shell element 20 can therefore be connected at points to the support structure 6.

The support structure 6 is preferably formed from plastic and therefore has a certain elasticity due solely to the material properties. The braces 8, 9 can be moved relative to each other, within certain limits.

A c-shaped seat leg 21, on which a non-illustrated seat surface can be fastened, is also situated on the base support 5.

The backrest legs 15, 16 point diagonally upward, in the embodiment shown.

Figure 2:
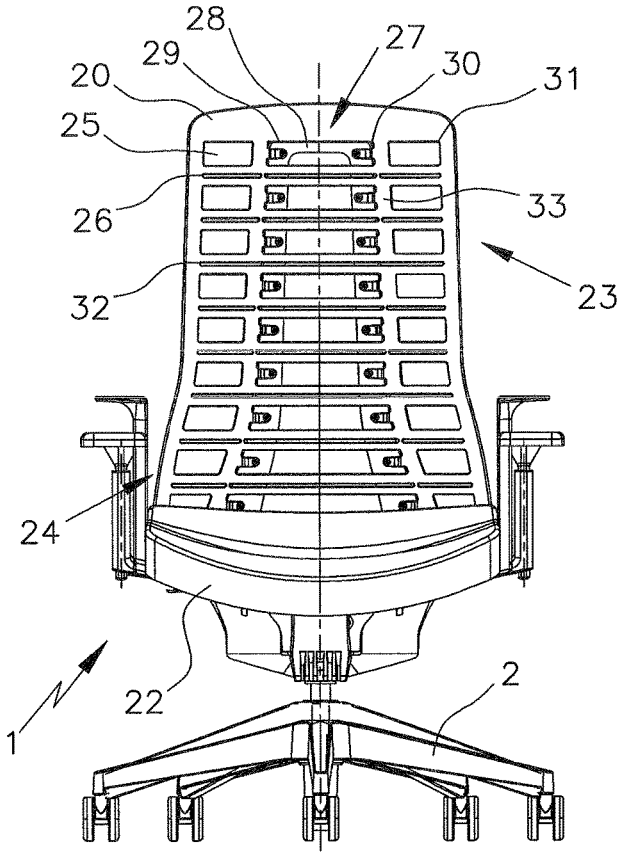
FIG. 2 shows a front view of the office chair from FIG. 1.

FIG. 2 presents the office chair 1 in a front view, wherein a seat surface 22 is visible here. The backrest shell element 20 is designed, in an upper area 23, having an approximately constant width. The width increases in a lower area 24. The backrest shell element 20 comprises openings 25 at a first height, and slot-like openings 26 at a second height. The height of the slot-like openings 26 is less than the height of the openings 25 in this case. In addition, the backrest shell element 20 has a central row 27 of openings 28. The openings 28 become wider as viewed from top to bottom. Fastening tabs 29, 30 for fastening the backrest shell element on the support structure 6 (FIG. 1) are provided in the edge areas of the openings 28. The fastening tabs 29, 30 are elastic and can be inserted into the openings 18. Narrower openings 25, 31 are provided to the right and to the left of the openings 28 of the central row (27) of openings 28. The openings 25, 31 in the edge area of the backrest shell element 20 are therefore narrower.

The slot-like openings 26 can be spaced from each other by webs. Continuous slots 32 also can be provided over approximately the entire width of the backrest shell element 20, however.

The backrest shell element 20 is preferably made from plastic. Due to the alternating arrangement of openings 25, 26, 28, 31 and webs 33, a skeleton-like structure results, which is particularly flexible.

Figure 3:
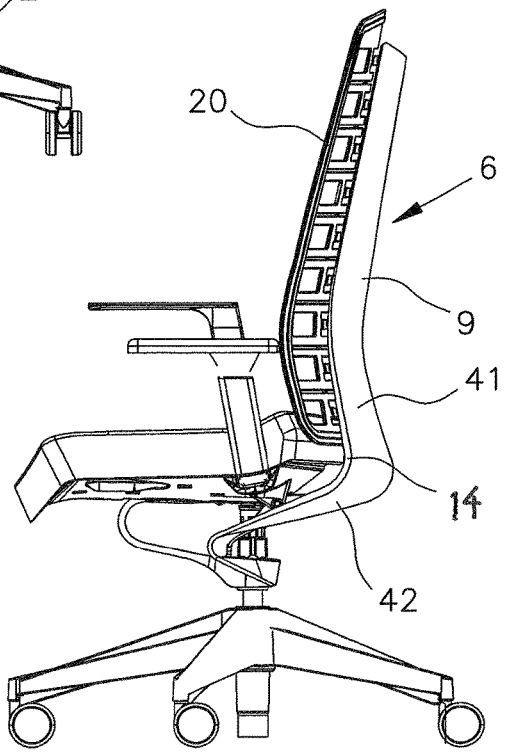
FIG. 3 shows a side view of the office chair.

FIG. 3 shows a side view of the office chair 1. It is apparent here that the backrest shell element 20 is connected to the support structure 6. In this case, the backrest shell element 20 is located above the bend area 14, at which sections 41, 42 of the braces 8, 9, assume an angle of approximately 90° with respect to one another.

Figure 4:
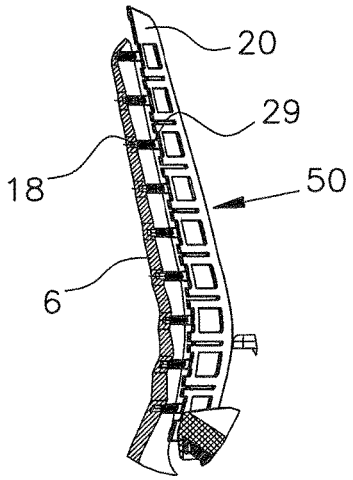
FIG. 4 shows a detail of the backrest in a partial sectional illustration.

FIG. 4 shows a cutaway of the backrest 50, wherein the support structure 6 is depicted in a sectional view. It is apparent here that the tabs 29, 30 have been inserted into the openings 18 of the support structure 6, and so a point connection of the backrest shell element 20 to the support structure 6 results at multiple points.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. A backrest for an office chair having a pedestal, the backrest comprising:

a backrest shell element having a plurality of through-holes and webs situated therebetween;

a support structure upon which the backrest shell element can be fastened; and first and second braces, each comprising upper and lower end regions;

wherein the first and second braces are interconnected at the upper and lower end regions;

wherein the first and second braces are spaced from each other between the upper and lower end regions;

wherein at least sections of the first and second braces are movable relative to one another, and wherein a portion of the plurality of through-holes embodies a central vertical row of through-holes, and a narrower through-hole of the plurality of through-holes is assigned to each through-hole of the central vertical row of through-holes, on the right and the left of the central vertical row of through holes.

2. The backrest according to claim 1, wherein the support structure is made from plastic.

3. The backrest according to claim 1, wherein the support structure has connection points for a point connection to the backrest shell element.

4. The backrest according to claim 1, wherein each of the first and second braces has a backrest leg that is elastic at least in some areas of the backrest leg.

5. The backrest according to claim 4, wherein each of the backrest legs are c-shaped.

6. The backrest according to claim 1, wherein the first and second braces are connected to a base support that is connected to the pedestal of the chair.

7. The backrest according to claim 1, wherein the first and second braces are oriented in parallel to one another in a first section.

8. The backrest according to claim 1, further comprising a base support and wherein a distance between the braces increases in a second section toward the part of the backrest comprising the base support.

9. The backrest according to claim 1, wherein a portion of the plurality of through-holes are arranged alternately in a direction corresponding to a vertical extent of the backrest shell element and are situated at a first height and at a second, greater height.

10. The backrest according to claim 1, wherein the through-holes of the central vertical row of through-holes become wider from top to bottom of the backrest shell element.

11. The backrest according to claim 1, wherein the backrest shell element comprises openings in the shape of slots.

12. The backrest according to claim 1, wherein elastic fastening tabs for detachable fastening on the support structure are provided on the backrest shell element.

13. An office chair comprising:

a pedestal; and a backrest according to claim 1.

* * * * *